US006121869A

United States Patent [19]

Burgess

[11] Patent Number: 6,121,869

[45] Date of Patent: Sep. 19, 2000

[54] PRESSURE ACTIVATED SWITCHING DEVICE

[76] Inventor: Lester E. Burgess, Box 522, Swarthmore, Pa. 19081

[21] Appl. No.: 09/399,631

[22] Filed: Sep. 20, 1999

[51] Int. Cl.[7] ..... H01C 10/10

[52] U.S. Cl. ..... 338/99; 338/47; 338/114; 200/511; 200/512

[58] Field of Search ..... 338/47, 99, 114; 200/511, 512, 514

[56] References Cited

U.S. PATENT DOCUMENTS

| | | | |
|---|---|---|---|
| 2,951,817 | 9/1960 | Myers . | |
| 3,315,050 | 4/1967 | Miller . | |
| 3,321,592 | 5/1967 | Miller . | |
| 3,634,334 | 1/1972 | Burgess . | |
| 3,668,337 | 6/1972 | Sinclair | 200/512 |
| 3,693,026 | 9/1972 | Miller . | |
| 3,859,485 | 1/1975 | Blinkilde et al. . | |
| 4,014,217 | 3/1977 | Lagasse et al. . | |
| 4,051,336 | 9/1977 | Miller . | |
| 4,121,488 | 10/1978 | Akiyama . | |
| 4,137,116 | 1/1979 | Miller . | |
| 4,143,367 | 3/1979 | Schestag . | |
| 4,172,216 | 10/1979 | O'Shea . | |
| 4,200,777 | 4/1980 | Miller . | |
| 4,252,391 | 2/1981 | Sado | 338/99 |
| 4,273,974 | 6/1981 | Miller . | |
| 4,317,013 | 2/1982 | Larson | 200/512 |
| 4,349,710 | 9/1982 | Miller . | |
| 4,396,814 | 8/1983 | Miller . | |
| 4,449,023 | 5/1984 | Hilhorst et al. | 200/514 |
| 4,481,815 | 11/1984 | Overton . | |
| 4,497,989 | 2/1985 | Miller . | |
| 4,620,072 | 10/1986 | Miller . | |
| 4,640,137 | 2/1987 | Trull et al. . | |
| 4,661,664 | 4/1987 | Miller . | |
| 4,785,143 | 11/1988 | Miller . | |
| 4,837,548 | 6/1989 | Lodini . | |
| 4,845,323 | 7/1989 | Beggs . | |
| 4,876,419 | 10/1989 | Lodini . | |
| 4,876,420 | 10/1989 | Lodini . | |
| 4,882,460 | 11/1989 | Mertens | 200/512 |
| 4,900,497 | 2/1990 | Lodini . | |
| 4,908,483 | 3/1990 | Miller . | |
| 4,920,241 | 4/1990 | Miller . | |
| 4,951,985 | 8/1990 | Pong et al. . | |
| 4,954,673 | 9/1990 | Miller . | |
| 4,964,302 | 10/1990 | Grahn et al. . | |
| 4,972,054 | 11/1990 | Miller et al. . | |
| 4,977,386 | 12/1990 | Lodini . | |
| 5,010,774 | 4/1991 | Kikuo et al. . | |
| 5,019,797 | 5/1991 | Marstiller et al. . | |
| 5,019,950 | 5/1991 | Johnson . | |
| 5,023,411 | 6/1991 | Miller et al. . | |
| 5,027,552 | 7/1991 | Miller et al. . | |
| 5,060,527 | 10/1991 | Burgess . | |
| 5,066,835 | 11/1991 | Miller et al. . | |
| 5,072,079 | 12/1991 | Miller . | |
| 5,089,672 | 2/1992 | Miller . | |
| 5,132,583 | 7/1992 | Chang . | |
| 5,264,824 | 11/1993 | Hour . | |
| 5,477,217 | 12/1995 | Bergan . | |
| 5,510,812 | 4/1996 | O'Mara . | |
| 5,886,615 | 3/1999 | Burgess | 338/114 |

FOREIGN PATENT DOCUMENTS

| | | |
|---|---|---|
| 0167341 | 1/1986 | European Pat. Off. . |
| 0293734 | 12/1988 | European Pat. Off. . |
| 1942565 | 4/1971 | Germany . |
| 2026894 | 12/1971 | Germany . |
| 2045527 | 10/1980 | United Kingdom . |

*Primary Examiner*—Karl Easthom
*Attorney, Agent, or Firm*—Dilworth & Barrese, LLP

[57] ABSTRACT

A pressure activated switching device includes an electrically insulative standoff positioned between two conductive layers. The standoff is preferably a polymeric or rubber foam configured in the form of contoured shapes having interdigitated lateral projections. Optionally, the switching device can include a piezoresistive material positioned between a conductive layer and the standoff. The pressure activated switching device can be used, for example, in a safety sensing edge system for a movable door.

34 Claims, 6 Drawing Sheets

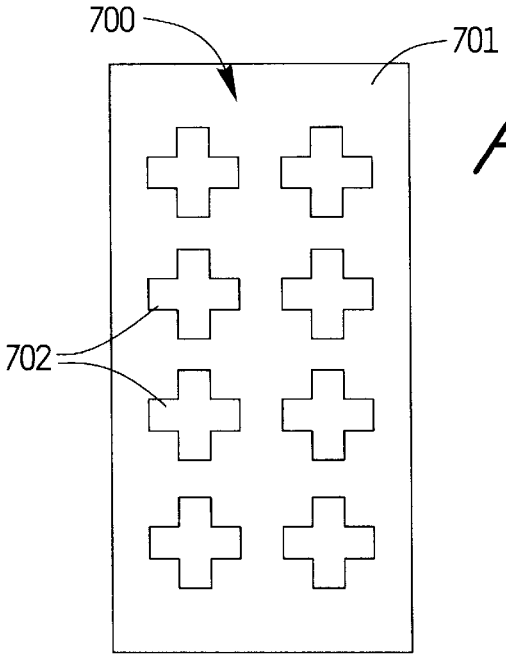
FIG_8
FIG_9
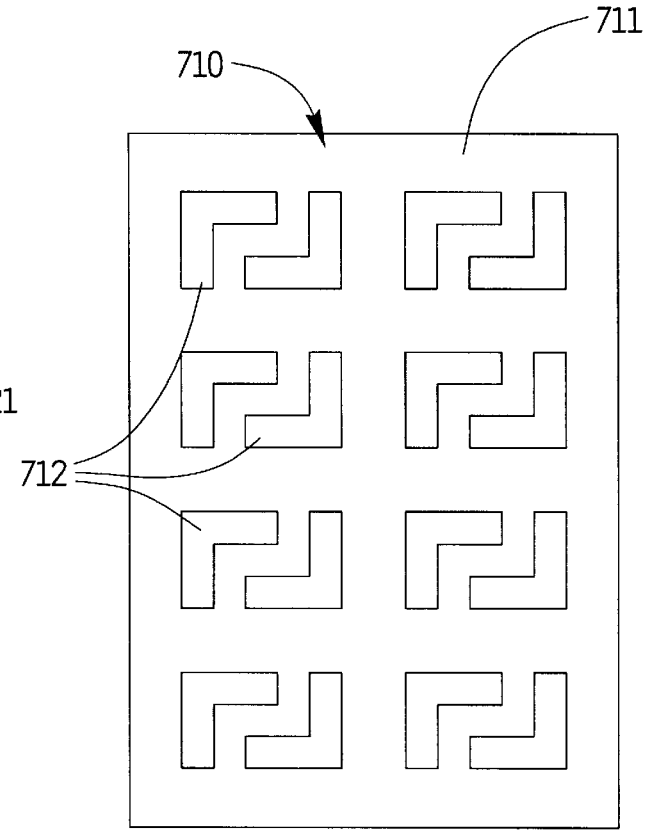
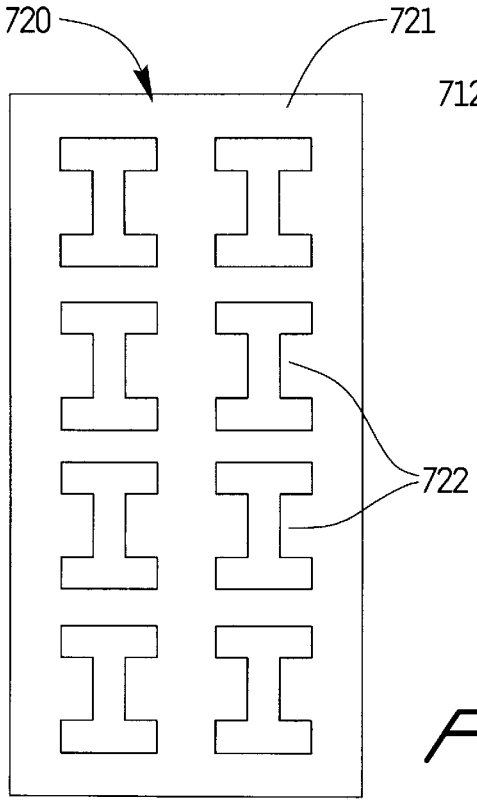
FIG_10

PRESSURE ACTIVATED SWITCHING DEVICE

BACKGROUND OF THE INVENTION

1. Field of the Invention

The present invention relates to a pressure activated switching device for closing or opening an electric circuit, and particularly to a safety edge for opening or stopping the movement of a door in response to contact with an object in its path.

2. Background of the Art

Pressure activated electrical switches are known in the art. Typically, such switches are used as floor mats in the vicinity of machinery to open or close electrical circuits or safety edges for doors. Sliding doors, (for example, in garages, factories, aircraft hangars, trains, elevators, etc.) pose a hazard to persons who may be in the path of the door as it is closing. Accordingly, such doors are typically fitted with force sensing switches along their leading edges. When the door contacts an object in its path the switch closes in response to the contact pressure. Closure of the switch can be used to send a signal to the door controller to stop or reverse the motion of the door.

Various types of force sensing switches, or "sensing edges" are known. Typically such switches include electrified conductive strips separated by a void space and/or a resilient standoff (e.g. polymeric foam). When pressure is applied to the switch, as for example when it contacts an object in the path of the moving door, the conductive strips are compressed toward each other and make contact, thereby closing an electric circuit.

For example, U.S. Pat. No. 4,396,814 to Miller discloses a safety edge switching device for a door wherein a resiliently compressible structure is enclosed in a flexible, impervious sheet covering, and the interior compartment is airtight, forming a pressurized cell. The device employs a foam layer of intermittent regularly spaced grids which expose the faces of upper and lower conductive strips. The grids are defined by two parallel portions of the foam connected by a plurality of crosspieces extending laterally from one side portion to the other, thereby forming a ladder-like pattern with spaces which are not interconnected. Upon compression, upper and lower conductive strips make electrical contact with each other through the one or more spaces in the foam layer.

Other sensing edges for doors are disclosed, for example, in U.S. Pat. Nos. 5,832,665, 5,728,984, 5,693,921, 5,426,293, 5,418,342, 5,345,671, 5,327,680, 5,299,387, 5,265,324, 5,262,603, 5,260,529, 5,225,640, 5,148,911, 5,089,672, 5,072,079, 5,066,835, 5,027,552, 5,023,411, 4,972,054, 4,954,673, 4,920,241, 4,908,483, 4,785,143, 4,620,072, 4,487,648, 4,349,710, 4,273,974, 4,051,336, 3,896,590, 3,855,733, 3,462,885, 3,321,592, 3,315,050, and 3,133,167.

While the known sensing edges have performed a useful function, there yet remains a need for a simply constructed, sensitive, but durable sensing edge for a door.

SUMMARY

A pressure activated switching device is provided herein which comprises:

a) a first conductive layer;

b) a second conductive layer spaced apart from the first conductive layer so as to define a planar space therebetween;

c) a standoff between the first and second conductive layers, the standoff including at least two insulative members, each insulative member including at least two intersecting linear portions, the members being arranged such that no portion of the planar space between the first and second conductive layers is completely surrounded by the insulative members.

The pressure activated switching device advantageously provides greater sensitivity and requires lower threshold forces for activation.

BRIEF DESCRIPTION OF THE DRAWINGS

FIGS. 7, 8, 9 and 10 are plan views illustrating alternative standoff configurations on the invention.

DETAILED DESCRIPTION OF PREFERRED EMBODIMENT(S)

The terms "insulating", "conducting", "resistance", and their related forms are used herein to refer to the electrical properties of the materials described, unless otherwise indicated. The terms "top", "bottom", "above", and "below", are used relative to each other. The terms "elastomer" and "elastomeric" are used herein to refer to material that can undergo at least 10% deformation elastically. Typically, "elastomeric" materials suitable for the purposes described herein can include polymeric materials such as elastomeric polyurethane, plasticized polyvinyl chloride, and silicone, and other synthetic and natural rubbers, and the like.

As used herein the term "piezoresistive" refers to a material having an electrical resistance which decreases in response to compression caused by mechanical pressure applied thereto in the direction of the current path. Such piezoresistive materials can be, for example, resilient cellular polymer foams with conductive coatings covering the walls of the cells.

"Resistance" refers to the opposition of the material to the flow of electric current along the current path in the material and is measured in ohms. Resistance increases proportionately with the length of the current path and the specific resistance, or "resistivity" of the material, and it varies inversely to the amount of cross sectional area available to the current. The resistivity is a property of the material and may be thought of as a measure of (resistance/length)/area. More particularly, the resistance may be determined in accordance with the following formula:

$$R=(\rho L)/A \qquad \text{(I)}$$

where

R=resistance in ohms

ρ=resistivity in ohm-inches

L=length in inches

A=area in square inches

The current through a circuit varies in proportion to the applied voltage and inversely with the resistance, as provided in Ohm's Law:

$$I=V/R \quad \text{(II)}$$

where

I=current in amperes

V=voltage in volts

R=resistance in ohms

Typically, the resistance of a flat conductive sheet across the plane of the sheet, i.e., from one edge to the opposite edge, is measured in units of ohms per square. For any given thickness of conductive sheet, the resistance value across the square remains the same no matter what the size of the square is. In applications where the current path is from one surface to another of the conductive sheet, i.e., in a direction perpendicular to the plane of the sheet, resistance is measured in ohms.

Figure 1:
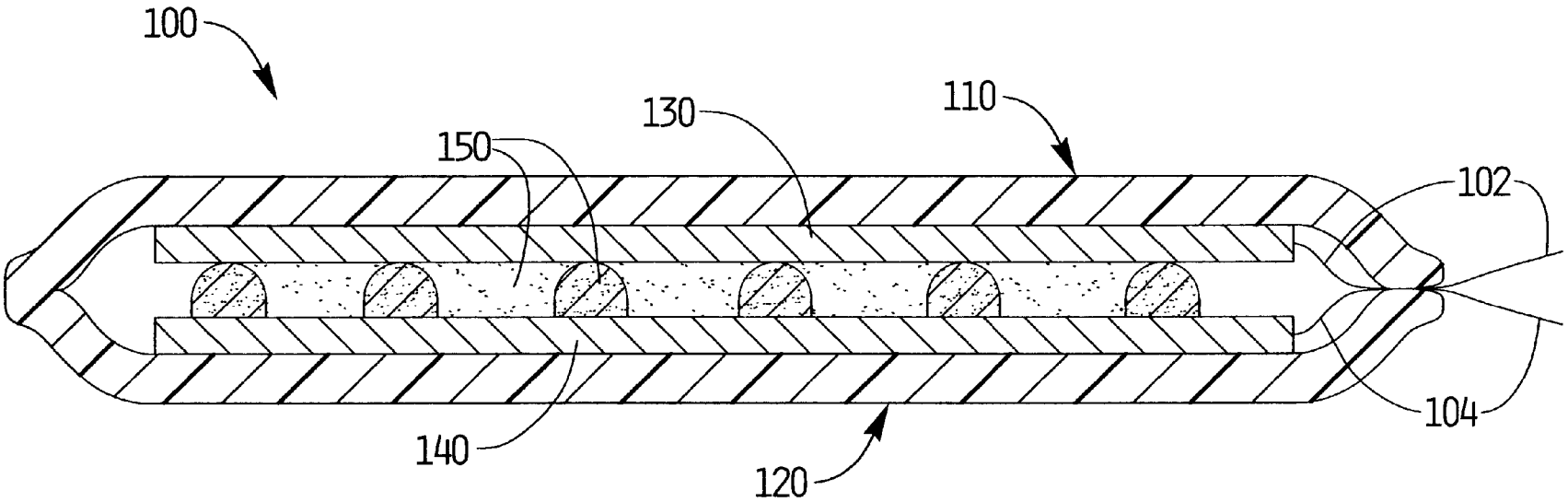
FIG. 1 is a sectional elevational view of the pressure activated switching device of the present invention.
Figure 2:
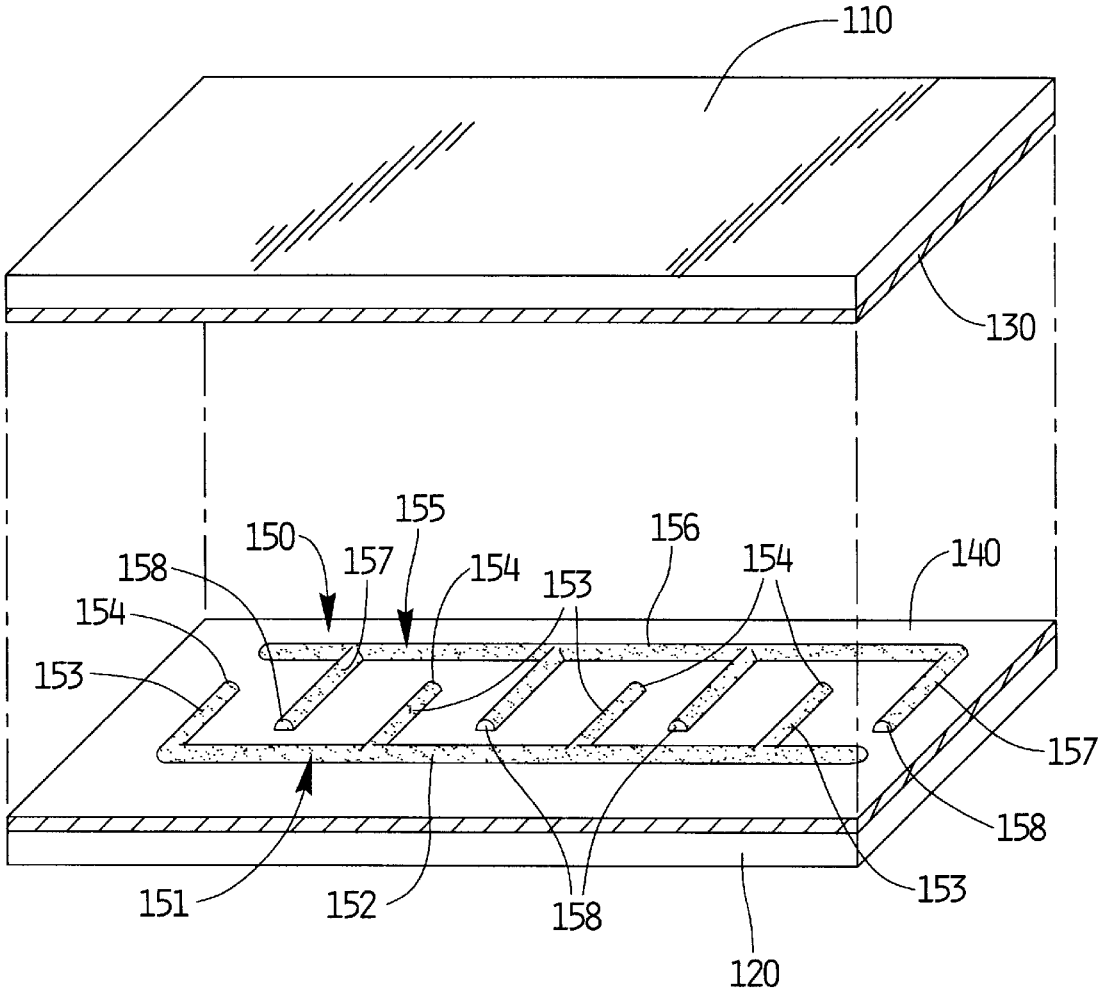
FIG. 2 is a perspective view of the switching device.

Referring now to FIGS. 1, and 2, the pressure activated switch 100 includes an upper cover layer 110, a base 120, upper and lower conductive layers 130 and 140, and a standoff, i.e. spacer element 150.

More particularly, cover layer 110 and base 120 are each sheets of any type of durable electrically insulative material capable of withstanding repeated applications of pressure and stresses under the operating conditions of the pressure activated switch 100. For example, cover layer 110 and base 120 can be fabricated from plastic or elastomeric materials. Preferred materials include natural or synthetic rubber, or other materials such as thermoplastic polymers, for example, polyurethane, silicone, and polyvinyl chloride ("PVC") sheeting. The sheeting can be relatively rigid or flexible to accommodate various environments or applications. The cover layer 110 and base 120 can be adhesively bonded or heat sealed around the periphery to form an hermetical seal for enclosing an interior space in which is positioned the components of switch 100 described below. The cover layer 110 and base 120 generally can range in thickness from about 1/32" to 1/2", preferably 1/8" to 1/4" (although other thicknesses may also be used when appropriate), and can be embossed, ribbed, or smooth surfaced. The cover layer 110 and base 120 can be of the same or different material, the same or different thickness, and have the same or different surface features.

Conductive layers 130 and 140 can be metallic foil or film applied to the interior surfaces of the cover 110 and base 120, respectively. Optionally, one or both of conductive layers 130 and 140 can be elastomeric. Elastomeric conductive layers can be fabricated from a polymeric elastomer which contains conductive filler such as finely powdered metal or carbon. A suitable conductive elastomeric material for use in the present invention is disclosed in U.S. Pat. No. 5,069,527, which is herein incorporated by reference. Conductive layers 130 and 140 are spaced apart from each other so as to define a planar space therebetween.

Conductive layers 130 and 140 are each connected to a wire lead 102 and 104, respectively. Wires 102 and 104 extend outside the switch 100 and can be electrically connected to control equipment to incorporate switch 100 into a control circuit. A current applied to leads 102, 104 will flow when conductive layers 130 and 140 are in contact, thereby forming a closed electric circuit.

The standoff of the present invention includes at least two strips of electrically insulative material which can be rigid or flexible. For example, the standoff can be fabricated from a solid (i.e., nonporous) synthetic polymer or natural rubber which can be rigid or elastomeric. Preferably, the standoff is resiliently flexible and capable of collapsing under a mechanical pressure and returning to its original size and configuration when the pressure is removed. The preferred material for fabricating the resiliently flexible standoff is an elastomeric polymeric or rubber foam. Polymeric or rubber foams are cellular materials formed by expanding a resin with a foaming agent prior to or during curing, as discussed below. The elastomeric foam applies a resilient biasing force to separate the two conductive layers 110 and 120 while the switch 100 is in the unactivated configuration. When the switch 100 is activated, i.e., when external pressure is applied to the top surface, the conductive layers 130 and 140 are moved toward each other against the biasing force of the foam standoff 150. If sufficient force is applied the conductive layers 130 and 140 will contact each other through the void areas between and around the standoff strips. Closure of the circuit sends a signal to the control equipment to initiate, alter, or cease operation of equipment.

When the mechanical pressure is removed, the resilient biasing force of the elastomeric foam standoff 150 moves conductive layers 130 and 140 apart, thereby reopening the electric circuit.

The threshold value of force is the minimum amount of externally applied force necessary to activate the device and is a measure of its sensitivity. The threshold value depends, at least in part, on the thickness of the standoff, its rigidity, and configuration.

Use of polymeric or rubber foam as a standoff provides an advantage over rigid, non-collapsible, standoffs. Sensitivity of the device to smaller mechanical pressures is increased and "dead space" around the standoff is decreased. Dead space is the area in which the upper and lower conductive layers 130 and 140 cannot make contact. Dead space can occur, for example, because the conductive layers cannot bend sharply around rigid standoffs.

The elastomeric foam can be open-celled or closed-celled and can be fabricated from any suitable material such as natural rubber, silicone rubber, plasticized PVC, thermoplastic or thermoset polyurethane, and the like. Typically such resins are expanded by means of a foaming agent to produce a cellular material. Foaming agents typically produce gasses when activated, and methods for producing polymeric foams are well known in the art.

Typically, the density of uncompressed elastomeric foam can range from about 1 pound per cubic foot ("pcf") to about 20 pfc. Void space as a percentage of total volume of uncompressed polymer foam can range from less than about 30% to more than 90%. Consequently, when the foam standoff collapses under pressure, the volume is correspondingly reduced. The conductive layers can come into contact with each other without having to bend sharply around the standoff. The greater the density (and correspondingly lesser void space) the greater the strength of the foam and its resistance to compression. Generally, a density of 2 pcf to 15 pcf for uncompressed foam is preferred. The thickness of the foam standoff can be selected to provide more or less sensitivity. Preferred thicknesses for the foam standoff can generally range from about 1/32 inch to about 2 inches, preferably 1/16 inch to 1 inch, and more preferably 1/4 inch to about 3/4 inch.

A significant feature of standoff 150 herein is its configuration. The standoff members, or strips, each include at least two intersecting linear portions. As can be seen from FIG. 2, standoff 150 includes strips 151 and 155.

Strip 151 includes a longitudinally oriented linear portion 152, and a plurality of spaced apart linear projections 153, which intersect and extend laterally at a generally right angle from linear portion 152, each of the lateral projections 153 having an end 154.

Strip 155 likewise includes a longitudinally oriented linear portion 156, and a plurality of spaced apart linear branches, i.e., projections 157, which intersect and extend laterally at a generally right angle from linear portion 156, each of the lateral projections 157 having in end 158.

Projections 153 extend toward linear portion 156 and projections 157 extend toward linear portion 152 in an alternating fashion so as to define a pattern of interdigitated lines of foam. As can be seen, no portion of the planar space between the conductive layers 130 and 140 is completely surrounded by the standoff so as to form a pocket or cell of trapped air. The ends 154 of projections 153 are spaced apart from linear portion 156 thereby defining a gap therebetween. Likewise, the ends 158 of projections 157 are spaced apart from linear portion 152, thereby defining a gap therebetween. These gaps provide a significant function in allowing the flow of air therethrough, which surprisingly increases the sensitivity and reduces the threshold value of force necessary to activate the switch 100. Without the gaps the spaces between the strips 151 and 155 would be configured into independent cells or pockets which can have the effect of trapping air. The trapped air can offer resistance to compression, thereby reducing sensitivity.

Figure 3:
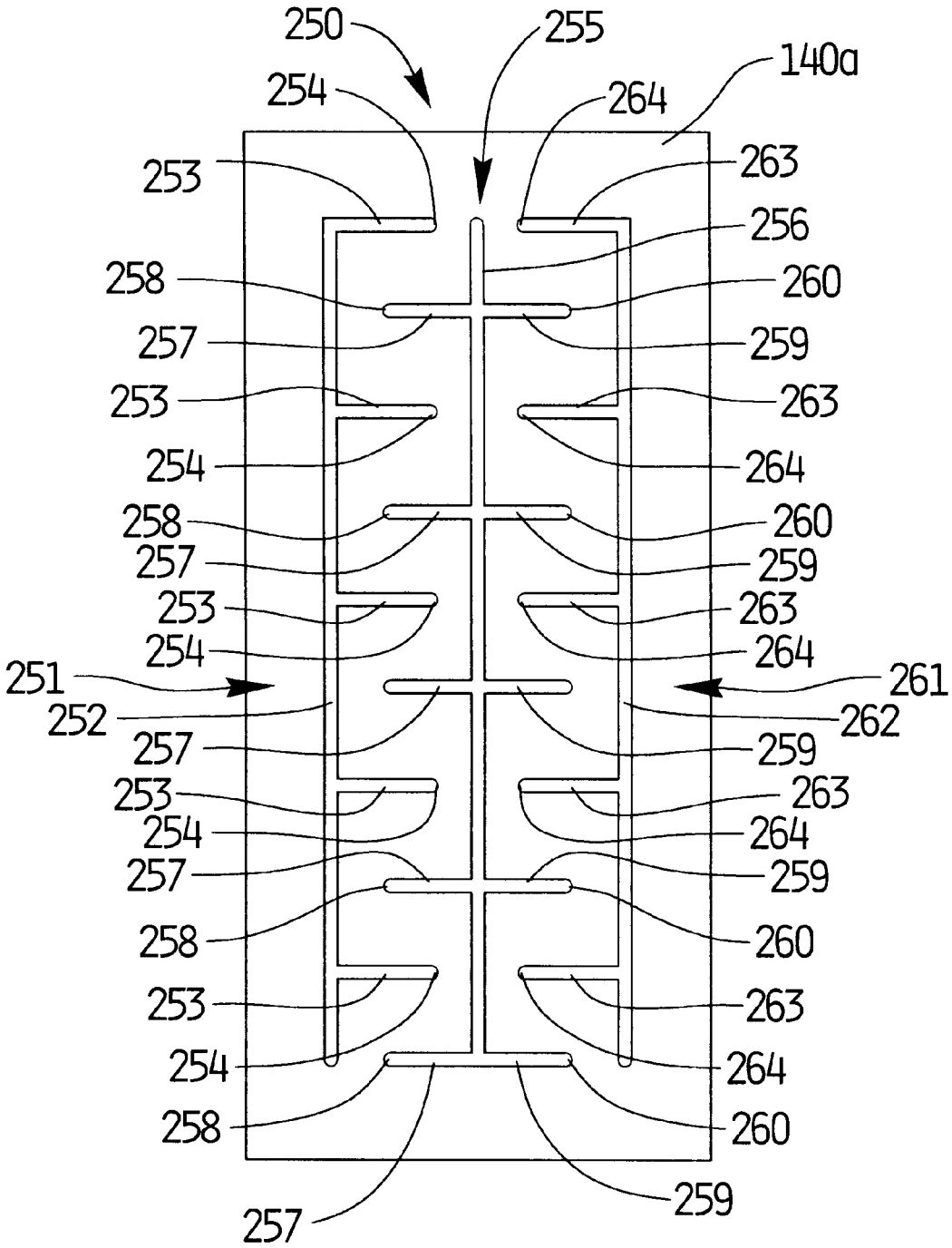
FIG. 3 is a plan view illustrating the standoff configuration of an alternative embodiment of the present invention.

Referring now to FIG. 3, an alternative embodiment of the invention is shown in which polymeric foam standoff 250 on lower conductive layer 140*a* includes three strips: first strip 251, second strip 255 and third strip 261.

First strip 251 includes a longitudinally oriented linear portion 252 and a plurality of spaced apart linear projections 253 which intersect and extend laterally from linear portion 252, each of the lateral projections 253 terminating in an end 254.

Strip 255 likewise includes a longitudinally oriented linear portion 256 and a plurality of spaced apart linear projections 257 which intersect and extend laterally from linear portion 256, each of the projections 257 terminating in an end 258.

Projections 253 extend toward linear portion 256 and projections 257 extend toward linear portion 252 in an alternating fashion so as to define a pattern of interdigitated lines of foam. The ends 254 of projections 253 are spaced apart from linear portion 256 so as to define a gap therebetween. Likewise, the ends 258 of projections 257 are spaced apart from linear portion 252 so as to define gaps therebetween. As mentioned above, these gaps permit the flow of air therethrough.

Additionally, second strip 255 includes on a side opposite that from which lateral projections 257 extend, a plurality of linear projections 259 intersecting and extending laterally from linear portion 256, each projection 259 terminating in an end 260.

Third strip 261 includes a linear portion 262 and a plurality of spaced apart projections 263 intersecting and extending laterally and at right angles from linear portion 262. The lateral projections 263 each terminate in an end 264.

Projections 257 extend toward linear portion 262 and projections 263 extend toward linear portion 256 in an alternating, interdigitated fashion with gaps between the ends of the lateral projections and the linear portions as described above.

Figure 4:
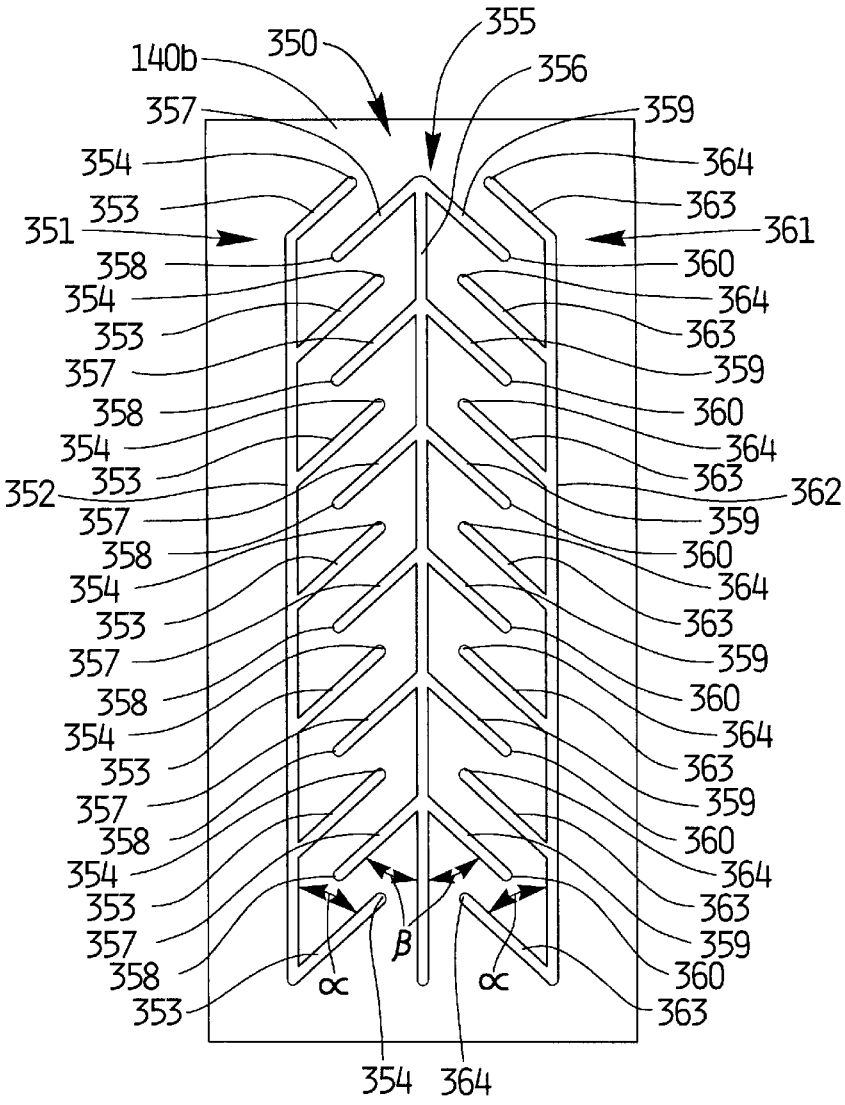
FIG. 4 is a plan view illustrating the standoff configuration of another embodiment of the present invention.

Referring now to FIG. 4, an alternative embodiment of the invention is shown in which standoff 350 on lower conductive layer 140*b* includes three strips: first strip 351, second strip 355 and third strip 361.

First strip 351 includes a longitudinally oriented linear portion 352 and a plurality of spaced apart linear projections 353 which intersect and extend laterally from linear portion 352, each of the lateral projections 353 terminating in an end 354. As can be seen, linear projections 353 extend at an angle $\alpha$ from the linear portion 352, wherein $\alpha$ is less than 90°, preferably between 30° and 90°, more preferably from about 45° to about 75°.

Strip 355 likewise includes a longitudinally oriented linear portion 356 and a plurality of spaced apart linear projections 357 which intersect and extend laterally from linear portion 356 each of the projections 357 terminating in an end 358. Linear projections 357 extend at an angle $\beta$ from linear portion 356, wherein $\beta$, is preferably between 30° and 90°, and more preferably from about 45° to about 75°. Preferably, angle $\beta$ is equal to angle $\alpha$.

Projections 353 extend toward linear portion 356 and projections 357 extend toward linear portion 352 in an alternating fashion so as to define a pattern of interdigitated lines of foam. The ends 354 of projections 353 are spaced apart from linear portion 356 so as to define a gap therebetween. Likewise, the ends 358 of projections 357 are spaced apart from linear portion 352 so as to define gaps therebetween. As mentioned above, these gaps permit the flow of air therethrough.

Additionally, second strip 355 includes on a side opposite that from which lateral projections 357 extend, a plurality of linear projections 359 extending laterally from linear portion 356 at angle $\beta$, each projection 359 terminating in an end 360.

Third strips 361 includes a linear portion 362 and a plurality of spaced apart projection 363 extending laterally and at angle $\alpha$ from linear portion 362. The lateral projections 363 each terminate in an end 364.

Projections 357 extend toward linear portion 362 and projections 363 extend toward linear portion 356 in an alternating, interdigitated fashion with gaps between the ends of the lateral projections and the linear portions as described above.

As can be seen, because of the angled orientation of the lateral projections 353, 357, 359 and 363, a generally herringbone type pattern is achieved.

Figure 7:
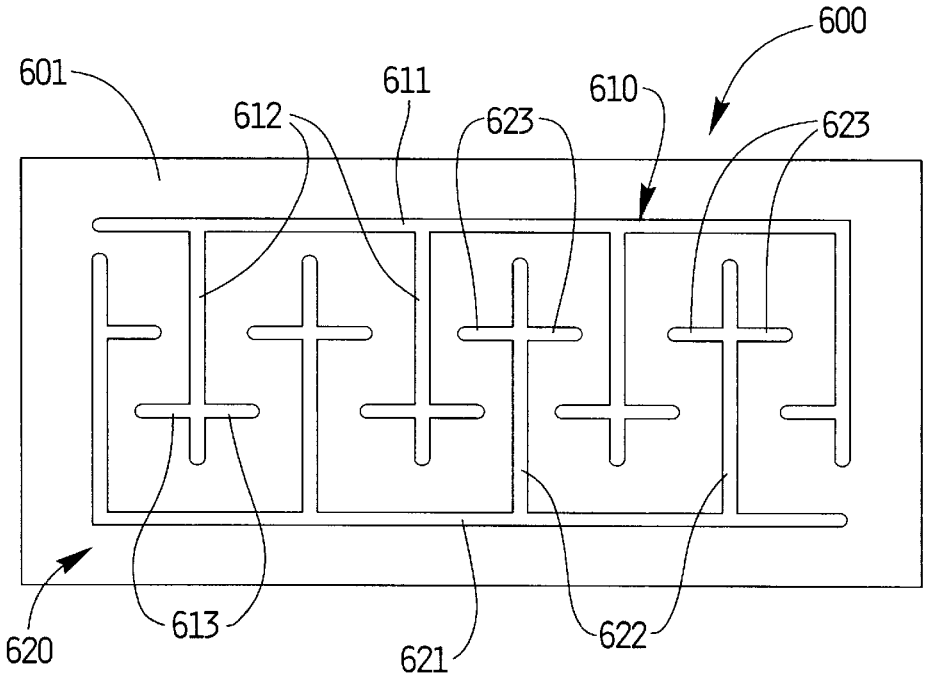

Referring to FIG. 7, in yet another embodiment the lateral projections of the standoff can also include further projections or branches therefrom. Standoff 600 on lower conductive layer 601 includes at least two strips 610 and 620, each strip having a longitudinally oriented linear portion 611, and 621, respectively, and lateral projections 612 622 intersecting and extending from the respective longitudinally oriented linear portions 611 and 621. As can be seen, the lateral projections 612 and 622 further include additional projections, or intersecting branches 613 and 623 respectively. Standoff 600 is preferably fabricated from an insulative elastomeric foam.

Referring now to FIGS. 8, 9, and 10, yet other embodiments of the standoff of the present invention are shown wherein standoff 700 on lower conductive layer 701 is in the form of a plurality of cross-shaped members 702 (FIG. 8), standoff 710 on lower conductive layer 711 is in the form of plurality of L-shaped members 712. Standoff 720 on lower conductive layer 721 is in the form of a plurality of I-shaped members 722. Standoffs 700, 710, and 720 are preferably fabricated from an insulative elastomeric foam.

Figure 5:
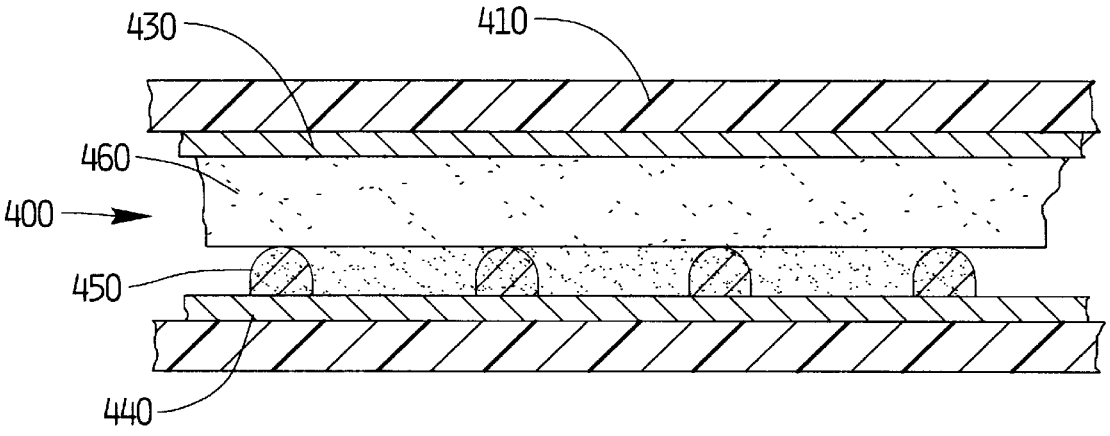
FIG. 5 is a sectional elevational view of a pressure activated switching device which includes a layer of piezoresistive material.

In yet another embodiment the pressure activated switching device can include a piezoresistive material between one conductive layer and the interdigitated standoff. Referring now to FIG. 5, pressure activated switching device 400 includes cover layer 410 and base 420 fabricated of PVC sheeting or other suitable material such as polyurethane or rubber in a manner similar to that of pressure activated switching device 100. Likewise, pressure activated switching device 400 includes conductive layers 430 and 440 similar to corresponding conductive layers 130 and 140 of pressure activated switching device 100. Standoff 450 is an interdigitated polymeric foam standoff such as standoff 150, 250, or 350, and preferably made of polymeric or rubber foam, although rigid or elastomeric solid standoffs made of, for example, synthetic polymer or natural rubber are also serviceable.

The piezoresistive layer 460 is cellular polymeric material which has been rendered conductive by, for example, incorporating conductive filler (e.g. metal powder, graphite) into the polymeric structure. One way to fabricate such a piezoresistive material is to introduce a conductive coating material into the void spaces of a pre-expanded polymer foam to coat the inside surfaces of the cells. Such piezoresistive materials are limited to open-celled foams to permit the interior cells of the foam to receive the conductive coating.

Another way to fabricate a cellular material, but without expansion, is to incorporate leachable particles into an uncured resin, such as silicone. The resin is then allowed to cure, after which the leachable particles are dissolved out of the polymer by a suitable solvent to leave a cellular mass.

An alternative conductive piezoresistive polymer foam suitable for use in the present invention is an intrinsically conductive expanded polymer (ICEP) cellular foam comprising an expanded polymer with premixed filler comprising conductive finely divided (preferably colloidal) particles and conductive fibers.

An intrinsically conductive expanded foam differs from the prior known expanded foams in that the foam matrix is itself conductive. The difficulty in fabricating an intrinsically conductive expanded foam is that the conductive filler particles, which have been premixed into the unexpanded polymeric resin spread apart from each other and lose contact with each other as the resin is expanded by the foaming agent, thereby creating an open circuit.

Surprisingly, the combination of conductive finely divided powder with conductive fibers allows the conductive filler to be premixed into the resin prior to expansion without loss of conductive ability when the resin is subsequently expanded. The conductive filler can comprise an effective amount of conductive powder combined with an effective amount of conductive fiber. By "effective amount" is meant an amount sufficient to maintain electrical conductance after expansion of the foam matrix. The conductive powder can be powdered metals such as copper, silver, nickel, gold, and the like, or powdered carbon such as carbon black and powdered graphite. The particle size of the conductive powder typically ranges from diameters of about 0.01 to about 25 microns. The conductive fibers can be metal fibers or, preferably, graphite, and typically range from about 0.1 to about 0.5 inches in length. Typically the amount of conductive powder range from about 15% to about 80% by weight of the total composition. The conductive fibers typically range from about 0.1% to about 10% by weight of the total composition.

The intrinsically conductive foam can be made according to the procedure described in U.S. Pat. No. 5,695,859, which is herein incorporated by reference. A significant advantage of intrinsically conductive foam is that it can be a closed cell foam, or an open celled foam.

As mentioned above, the resistance of the piezoresistive material decreases as the piezoresistive material is compressed under mechanical pressure. Hence, when part of an electric circuit, the piezoresistive material provides a way to measure the force applied to it by measuring the current flow.

The standoff 450, which is an insulator, provides an on-off function. As can be seen from FIG. 5, the piezoresistive material 460 is in contact with upper conductive layer 430. The insulative standoff 450 is positioned between piezoresistive layer 460 and the lower conductive layer 440. In the absence of compressive force there is no contact between the piezoresistive layer 460 and the lower conductive layer 440. Upon application of a compressive force to the upper surface of cover layer 410 the standoff 450 compresses. When a threshold level of compressive force is applied the piezoresistive layer 460 makes contact with the lower conductive layer 440 through the spaces in the standoff 450 and the switching device 400 is activated, i.e. a current flows through a closed circuit. Thereafter, any additional force beyond the threshold level registers as an increase in the current flow. Thus, the magnitude of the compressive force can be measured. The sensitivity of the switching device 400, i.e. its responsiveness to low threshold force, depends, at least in part, on the thickness of the standoff and its resistance to compression.

Figure 6:
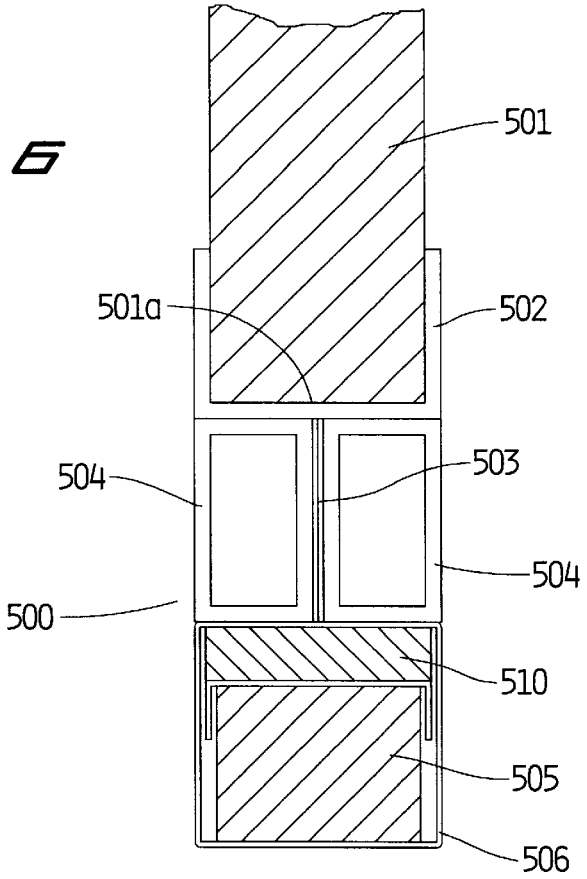
FIG. 6 is a diagrammatic sectional view illustrating a safety sensing edge system for a door.

FIG. 6 illustrates a safety sensing edge system 500 for a door. Door 501 can be any type of moving door, and is typically a motorized sliding door such as those used, for example, in garages, factories, aircraft hangars, trains, elevators, etc. A bracket 502 is fastened to the leading edge 501*a* of the door for mounting the safety sending edge system. The safety sensing edge system 500 includes a pressure activated switching device 510 incorporating first and second conductive layers separated by the standoff described herein. The pressure activated switching device 510 can be, for example, switching devices 100 or 400 described above, or may include a standoff such as illustrated in FIGS. 3 or 4, or combinations thereof. A resiliently compressible polymeric foam block 505 serves as a sealing gasket when the door is closed. It provides for compression against the floor or door threshold plate to prevent the entry of rain, wind, small mammals, etc. The foam gasket 505 and switching device 510 are sealed within a housing 506 fabricated from a strong flexible material such as, e.g. polyvinyl chloride. A fin 503 serves to connect the housing 506 to the bracket 502. Clamping fixture 504 provides additional structural support for the fin 503. Electrical wire leads (not shown) from the switching device 510 are connected to a control circuit (not shown) for operating the door 501. Suitable circuitry is known to those with skill in the art. For example, if there is an object (e.g., a person, animal, vehicle, etc.) in the path of the leading edge 501*a* of the moving door, upon contact with the object, foam gasket 505 compresses, and the compression force is transmitted to the switching device 510, which is thereby activated, closing the electrical circuit as explained above. This sends a signal to the control circuitry which may then stop or reverse the movement of door 501.

The following Examples and Comparative Examples illustrate the superior performance of the standoff of the present invention over that of a prior known standoff as illustrated in U.S. Pat. No. 4,396,814 over several size ranges.

The standoffs were each fabricated from a resiliently compressible polymeric foam material and each included two lengthwise parallel portions with a plurality of laterally extending cross pieces. In the prior art standoff the cross pieces connected the lengthwise parallel portions so as to define a ladder-like pattern with openings which were not interconnected. The foam standoffs of the present invention were fabricated from the same foam material as that of the comparative prior art foam standoff, except that the cross pieces were cut to form an interdigitated pattern as illustrated in FIG. 2 herein. Both foam standoff patterns were 1.91 inches wide.

A force tester available from AMETEK Co. was provided. Samples of foam standoff were placed between two conductive sheets to form a test switch, the conductive sheets being connected by electrical leads to a volt/ohm meter. A top and bottom cover enclosed the test switch. With test switch positioned on a base, a pressure disk of predetermined diameter was applied compressive force to the test switch edge configuration. The amount of force, in pounds, necessary to activate the test switch, i.e. the threshold force or "set-off force" was determined. The set-off force determination was made for two positions of the pressure disk relative to the standoff. In one position, "A", the disk is centered upon the cross pieces of the standoff. In position "B" the disk was centered upon the open spaces between the cross pieces.

The two sensor test configurations were the identical except for the difference of the foam standoff patterns. The sensor edge test configuration of the actual sensors had housings and electrodes similar to FIG. 1. The edge sensor was similar to FIG. 6, but for test convenience, the sensor element 510 was on the bottom side and the gasketing foam 505 was on the top. A cover 506 was provided. The tests were carried out using two thicknesses of gasketing [about 2 pcf density elastomer polyurethane] foam 505. (1.375" and 0.5" thick).

COMPARATIVE EXAMPLE 1

A prior art foam standoff sample was tested for set-off force using the method described above. The gasketing foam of the test edge sensor was 1.375 inches thick. The pressure applicator disk was 2.26 inches in diameter and was located in the A position. The test was performed three times and the results averaged. The average set-off force necessary to initiate activation was measured to be 9.9 lbs.

COMPARATIVE EXAMPLE 2

This Comparative Example of a prior art foam standoff was performed in a manner similar to Comparative Example 1 except that the disk was in the B position. The average set-off force necessary to initiate activation was measured to be 8.6 lbs.

COMPARATIVE EXAMPLE 3

A prior art foam standoff sample was tested for set-off force using the method described above. The gasketing foam of the test edge sensor was 0.5 inches thick. The pressure applicator disk was 2.26 inches in diameter and was located in the A position. The test was performed three times and the results averaged. The average set-off force necessary to initiate activation was measured to be 8.7 lbs.

COMPARATIVE EXAMPLE 4

This Comparative Example of a prior art foam standoff was performed in a manner similar to Comparative Example 3 except that the disk was in the B position. The average set-off force necessary to initiate activation was measured to be 11.8 lbs.

COMPARATIVE EXAMPLE 5

A prior art foam standoff sample was tested for set-off force using the method described above. The gasketing foam of the test edge sensor was 1.375 inches thick. The pressure applicator disk was 1.0 inch in diameter and was located in the A position. The test was performed three times and the results averaged. The average set-off force necessary to initiate activation was measured to be 4.6 lbs.

COMPARATIVE EXAMPLE 6

This Comparative Example of a prior art foam standoff was performed in a manner similar to Comparative Example 5 except that the disk was in the B position. The average set-off force necessary to initiate activation was measured to be 15.0 lbs.

COMPARATIVE EXAMPLE 7

A prior art foam standoff sample was tested for set-off force using the method described above. The gasketing foam of the test edge sensor was 0.5 inches thick. The pressure applicator disk was 1.0 inches in diameter and was located in the A position. The test was performed three times and the results averaged. The average set-off force necessary to initiate activation was measured to be 4.0 lbs.

COMPARATIVE EXAMPLE 8

This Comparative Example of a prior art foam standoff was performed in a manner similar to Comparative Example 7 except that the disk was in the B position. The average set-off force necessary to initiate activation was measured to be 28.0 lbs.

EXAMPLE 1

A foam standoff sample in accordance with the present invention was tested for set-off force using the method described above. The gasketing foam of the test edge sensor was 1.375 inches thick. The pressure applicator disk was 2.26 inches in diameter and was located in the A position. The test was performed three times and the results averaged. The average set-off force necessary to initiate activation of the switch was measured to be 6.2 lbs.

EXAMPLE 2

This Example was performed in a manner similar to Example 1 except that the pressure applicator disk was in the B position. The average set-off force necessary to initiate activation was measured to be 6.0 lbs.

EXAMPLE 3

A foam standoff sample in accordance with the present invention was tested for set-off force using the method described above. The gasketing foam of the test edge sensor was 0.5 inches thick. The pressure applicator disk was 2.26 inches in diameter and was located in the A position. The test was performed three times and the results averaged. The average set-off force necessary to initiate activation of the switch was measured to be 7.6 lbs.

EXAMPLE 4

This Example was performed in a manner similar to Example 3 except that the pressure applicator disk was in the B position. The average set-off force necessary to initiate activation was measured to be 6.9 lbs.

EXAMPLE 5

A foam standoff sample in accordance with the present invention was tested for set-off force using the method described above. The gasketing foam of the test edge sensor was 1.375 inches thick. The pressure applicator disk was 1.0 inches in diameter and was located in the A position. The test was performed three times and the results averaged. The average set-off force necessary to initiate activation of the switch was measured to be 4.3 lbs.

EXAMPLE 6

This Example was performed in a manner similar to Example 5 except that the pressure applicator disk was in the B position. The average set-off force necessary to initiate activation was measured to be 7.7 lbs.

EXAMPLE 7

A foam standoff sample in accordance with the present invention was tested for set-off force using the method described above. The gasketing foam of the test edge sensor was 0.5 inches thick. The pressure applicator disk was 1.0 inches in diameter and was located in the A position. The test was performed three times and the results averaged. The average set-off force necessary to initiate activation of the switch was measured to be 4.0 lbs.

EXAMPLE 8

This Example was performed in a manner similar to Example 7 except that the pressure applicator disk was in the B position. The average set-off force necessary to initiate activation was measured to be 9.8 lbs.

The results of the above prior art Comparative Examples of the present invention and Examples are presented below in Table 1.

TABLE 1

| | | | | Setoff Force (lbs.) | | |
|---|---|---|---|---|---|---|
| No. | Gasketing Foam Thickness | Disk Diameter | Disk Position | Prior Art Comp. Exmpl. | Examples of Current Invention | % Reduction |
| 1 | 1.375 | 2.26 | A | 9.9 | 6.2 | 39 |
| 2 | 1.375 | 2.26 | B | 8.6 | 6.0 | 32 |
| 3 | 0.5 | 2.26 | A | 8.7 | 7.6 | 13 |
| 4 | 0.5 | 2.26 | B | 11.8 | 6.9 | 42 |
| 5 | 1.375 | 1.0 | A | 4.6 | 4.3 | 6 |
| 6 | 1.375 | 1.0 | B | 15.0 | 7.7 | 49 |
| 7 | 0.5 | 1.0 | A | 4.0 | 4.0 | 0 |
| 8 | 0.5 | 1.0 | B | 28.0 | 9.8 | 65 |

As can be seen from the above data a switch which incorporates the standoff of the present invention is characterized by a lower set-off force and is more sensitive than a switch using the prior known standoff. Use of the present invention rather than the prior art standoff achieves a reduction in the required set-off force of up to 65%.

It will be understood that various modifications may be made to the embodiments described herein. For example, the projections or branches of the standoff may themselves include further projections or branches. Branches can be spaced in strategically placed arrangements to accommodate large mat sensors. Therefore, while the above description contains many specifics, these specifics should not be construed as limitations on the scope of the inventions but merely as exemplifications of preferred embodiments thereof. Those skilled in the art will envision many other possible variations that are within the scope and spirit of the invention as defined by the claims appended hereto.

What is claimed is:

1. A pressure activated switching device which comprises:

a) a planar first conductive layer;

b) a planar second conductive layer spaced apart from the first conductive layer so as to define a planar space therebetween;

c) a stand-off between the first and second conductive layers, the standoff including at least two monolithic insulative members, each monolithic insulative member including at least two intersecting linear portions, the monolithic insulative members being arranged such that no portion of the planar space between the first and second conductive layers is completely surrounded by any one of the insulative members.

2. The device of claim 1 wherein the standoff is fabricated from an elastomeric foam material.

3. The device of claim 2, wherein the monolithic insulative members of the standoff are each configured in a shape selected from the group consisting of cross-shaped, L-shaped and I-shaped.

4. The device of claim 1 wherein the standoff is a rigid or elastomeric solid material.

5. The device of claim 4 wherein the standoff is fabricated from a synthetic polymer or natural rubber.

6. The pressure activated switching device of claim 1 wherein the monolithic insulative members are arranged in an interdigitated pattern.

7. The pressure activated switching device of claim 1 wherein the first conductive layer is electrically connected to a first lead wire and the second conductive layer is electrically connected to a second lead wire, said first and second lead wires extending outside the pressure activated switching device for connection to an electric circuit.

8. A pressure activated switching device which comprises:

a) a first conductive layer;

b) a second conductive layer;

c) a standoff between the first conductive layer and the second conductive layer, said standoff including a first strip of an electrically insulative material having a longitudinally oriented linear first portion and a plurality of spaced apart linear first projections extending laterally from the first portion and each of the first projections having an end, a second strip of the electrically insulative material having a longitudinally oriented linear second portion and a plurality of spaced apart linear second projections extending laterally from the second portion and each of the second projections having an end, said first and second strips not crossing over each other, wherein at least two of the first projections of the first strip extend towards the second portion of the second strip, the respective ends of the first projections being spaced apart from the second portion of the second strip, and wherein at least two of the second projections of the second strip extend towards the first portion of the first strip, the respective ends of the second projections being spaced apart from the first portion of the first strip.

9. The device of claim 8 wherein the first and second linear portions are parallel to each other.

10. The device of claim 8 wherein the at least two first projections and the at least two second projections are parallel to each other.

11. The device of claim 8 wherein the at least two first projections and the at least two second projections are arranged in an alternating pattern.

12. The device of claim 8 wherein the at least two first projections and the at least two second projections are perpendicular to the respective first and second linear portions.

13. The device of claim 8 wherein the at least two first projections and the at least two second projections are angled from the respective first and second linear portions.

14. The device of claim 13 wherein the angle between the at least two first projections and at least two second projections and the respective first and second linear portions is between about 30° and 90°.

15. The device of claim 13 wherein the angle between the at least two first projections and at least two second projections and the respective first and second linear portions is between about 45° and 75°.

16. The device of claim 8 further including a third strip of electrically insulative material having a longitudinally oriented linear third portion and a plurality of spaced apart linear third projections extending laterally from the second portion and each of the third projections terminating in an end, wherein the linear second portion includes a first side and a second side opposite the first side, the at least two linear second projections extending from the first side of the second portion, wherein the second strip further includes a plurality of spaced apart fourth projections extending laterally from the second side of the second portion, each of the fourth projections terminating in an end, wherein at least two of the fourth projections of the second strip extend towards the linear third portion of the third strip, the respective ends of the fourth projections being spaced apart from the third portion of the third strip, and at least two of the third projections of the third strip extend towards the second portion of the second strip, the respective ends of the third projections being spaced apart from the second portion of the second strip.

17. The device of claim 8 wherein said electrically insulative material is an elastomeric foam.

18. The device of claim 17 wherein said elastomeric foam is an expanded synthetic polymer or an expanded natural rubber.

19. The device of claim 8 further including an insulative cover layer and an insulative base layer peripherally sealed to the insulative cover layer so as to define an interior space, said first conductive layer, standoff, and second conductive layer being positioned in said interior space.

20. The device of claim 15 wherein said cover layer and said base layer are fabricated from a material selected from the group consisting of synthetic rubber, natural rubber, polyurethane, silicone and polyvinyl chloride.

21. The device of claim 8 wherein the first conductive layer and second conductive layer each comprise a metal film.

22. The device of claim 8 wherein the first conductive layer and second conductive layer each comprise a conductive elastomeric material.

23. The device of claim 8 further including a layer of piezoresistive material positioned between said first conductive material and said standoff.

24. The device of claim 8 wherein the standoff has a thickness of from between about 1/32 inch to about 2 inches.

25. The pressure activated switching device of claim 8 wherein the first conductive layer is electrically connected to a first lead wire and the second conductive layer is electrically connected to a second lead wire, said first and second lead wires extending outside the pressure activated switching device for connection to an electric circuit.

26. A safety sensing edge system for a door comprising:

a) a pressure activated switching device which includes, i) a first conductive layer;

ii) a second conductive layer;

iii) a standoff between the first conductive layer and the second conductive layer, said standoff including a first strip of an electrically insulative material having a longitudinally oriented linear first portion and a plurality of spaced apart linear first projections extending laterally from the first portion and each of the first projections terminating in an end, a second strip of the electrically insulative material having a longitudinally oriented linear second portion and a plurality of spaced apart linear second projections extending laterally from the second portion and each of the second projections terminating in an end, said first and second strips not crossing over each other, wherein at least two of the first projections of the first strip extend towards the second portion of the second strip, the respective ends of the first projections being spaced apart from the second portion of the second strip, and wherein at least two of the second projections of the second strip extend towards the first portion of the first strip, the respective ends of the second projections being spaced apart from the first portion of the first strip;

b) a cover for enclosing the pressure activated switching device;

c) a bracket for mounting the pressure activated switching device.

27. The safety sensing edge system of claim 26 wherein the electrically insulative material is a polymeric foam.

28. The safety sensing edge system of claim 26 wherein the standoff is a rigid or elastomeric solid material.

29. The safety sensing edge system of claim 28 wherein the standoff is fabricated from a synthetic polymer or natural rubber.

30. The safety sensing edge system of claim 26 wherein the first and second projections are perpendicular to the respective first and second linear portions.

31. The safety sensing edge system of claim 26 wherein the first and second projections are angled from the respective first and second linear portions at an angle of substantially less than 90°.

32. The safety edge system of claim 26 wherein the pressure activated switching device includes a piezoresistive material positioned between the first conductive layer and the standoff.

33. The safety edge system of claim 26 further including a movable door wherein said system is mounted to a leading edge of the movable door.

34. The safety sensing edge system of claim 26 wherein the first and second projections are angled from the respective first and second linear portions at an angle of from 45° to 75°.

* * * * *